US007071404B1

(12) United States Patent
Smith

(10) Patent No.: US 7,071,404 B1
(45) Date of Patent: Jul. 4, 2006

(54) LASER ACTIVATED SYNTHESIZER SYSTEM

(76) Inventor: Laura A. Smith, 70 Sparkling Ridge, New Paltz, NY (US) 12561

( * ) Notice: Subject to any disclaimer, the term of this patent is extended or adjusted under 35 U.S.C. 154(b) by 0 days.

(21) Appl. No.: 11/237,812

(22) Filed: Sep. 27, 2005

(51) Int. Cl.
*G10H 3/06* (2006.01)

(52) U.S. Cl. ..... 84/724

(58) Field of Classification Search ..... 84/724
See application file for complete search history.

(56) References Cited

U.S. PATENT DOCUMENTS

| | | | | |
|---|---|---|---|---|
| 433,315 | A | 7/1890 | Berggren | |
| 785,406 | A | 3/1905 | Cochrane | |
| 4,322,997 | A | 4/1982 | Anstis | 84/479 |
| 4,489,227 | A | 12/1984 | Lamarche | 200/314 |
| 4,510,839 | A | 4/1985 | Kumano | 84/434 |
| 4,885,969 | A | 12/1989 | Chesters | 84/1.01 |
| 4,899,631 | A | 2/1990 | Baker | 84/719 |
| 5,017,770 | A * | 5/1991 | Sigalov | 250/221 |
| 5,107,743 | A | 4/1992 | Decker | 84/478 |
| 5,158,003 | A | 10/1992 | Lee | 84/439 |
| 5,783,764 | A | 7/1998 | Amar | 84/479 |
| 5,990,409 | A * | 11/1999 | Takahashi et al. | 84/724 |
| 6,348,649 | B1 | 2/2002 | Chen et al. | 84/477 |
| 6,372,975 | B1 | 4/2002 | Shinsky | 84/612 |
| 6,448,486 | B1 | 9/2002 | Shinsky | 84/613 |
| 6,703,552 | B1 | 3/2004 | Haken | 84/658 |
| 6,711,200 | B1 | 3/2004 | Scherer et al. | 372/64 |
| 6,794,568 | B1 * | 9/2004 | Callaway | 84/724 |
| 6,804,283 | B1 | 10/2004 | Scherer | 372/50 |
| 6,960,715 | B1 * | 11/2005 | Riopelle | 84/725 |
| 2003/0151628 | A1 | 8/2003 | Salter | 345/773 |
| 2003/0202753 | A1 * | 10/2003 | Kato et al. | 385/88 |
| 2004/0025676 | A1 | 2/2004 | Shadd | 84/743 |
| 2004/0200338 | A1 * | 10/2004 | Pangrie | 84/724 |

OTHER PUBLICATIONS www.photonics.com, Researchers Build Semiconductor Laser Using Photonic Crystal, Website Printout, Publication Date Unknown, 3 Pages.
www.en.wikipedia.org, Photonic Crystal, Website Printout, Publication Date Unknown, 2 Pages.

(Continued)

*Primary Examiner*—Jeffrey W Donels

(57) ABSTRACT

A laser activated synthesizer system for efficiently translating finger positions on a surface into sounds. The laser activated synthesizer system includes a housing member which encloses a plurality of lasers near an upper surface, each laser aligned with a piano like key arrangement etched into a lower surface, a laser pickup, a control unit and a synthesizer. The lasers are each individually touch sensitive and require minimal effort to activate. The keys are etched in either a 61 key configuration or 88 key configuration. The laser pickup senses the activation of each laser while the control unit electrically connected to the laser pickup determines which laser(s) are being activated and sends the information to the synthesizer to emit the correct note or chord.

16 Claims, 7 Drawing Sheets

OTHER PUBLICATIONS www.photonics.com, Photonic Crystal Lattice Controls, Website Printout, Publication Date Unknown, 2 pages.
www.opticalfilters.co.uk, EMI-ito Coated Glass, Website Printout, Publication Date Unknown, 1 Page.
www.opticalcoatings.com, Website Printout, Publication Date Unknown, 3 Pages.
www.en.wikipedia.org, Synthesizer, Website Printout, Publication Date Unknown, 10 Pages.
www.yamaha.com, EZ-AG, Website Printout, Publication Date Unknown, 3 Pages.
www.calpoly.edu, Laser Pickup System, Website Printout, Publication Date Unknown, 2 Pages.

* cited by examiner

LASER ACTIVATED SYNTHESIZER SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to electrical keyboard instruments and more specifically it relates to a laser activated synthesizer system for efficiently translating finger positions on a surface into sounds.

2. Description of the Related Art

Any discussion of the prior art throughout the specification should in no way be considered as an admission that such prior art is widely known or forms part of common general knowledge in the field.

Electrical instruments have been in use for years. Typically, electrical instruments utilize a keyboard (similar to a standard piano) in communication with a synthesizer in order to translate individual finger movements into musical notes or chords. Some newer electrical instruments (e.g. drums) utilize touch pads or membrane switches to function as keys to communicate with the synthesizer. Unfortunately, current electrical instruments require the user to physical depress each individual key which is not only difficult for some individuals (e.g. suffers of arthritis, physically disabled, children), but also slows the playing process.

While these units may be suitable for the particular purpose to which they address, they are not as suitable for efficiently translating finger positions on a surface to musical notes or chords. Current keyboard synthesizers require discrete keys to be motionably actuated in order to generate the desired notes and/or chords.

In these respects, the laser activated synthesizer system according to the present invention substantially departs from the conventional concepts and designs of the prior art, and in so doing provides an apparatus primarily developed for the purpose of efficiently translating finger positions on a surface into sounds.

BRIEF SUMMARY OF THE INVENTION

In view of the foregoing disadvantages inherent in the known types of electrical keyboard instruments now present in the prior art, the present invention provides a new laser activated synthesizer system construction wherein the same can be utilized for efficiently translating finger positions on a surface into sounds.

The general purpose of the present invention, which will be described subsequently in greater detail, is to provide a new laser activated synthesizer system that has many of the advantages of the electrical keyboard instruments mentioned heretofore and many novel features that result in a new laser activated synthesizer system which is not anticipated, rendered obvious, suggested, or even implied by any of the prior art electrical keyboard instruments, either alone or in any combination thereof.

To attain this, the present invention generally comprises a housing member which encloses a plurality of laser sensors near an upper surface, each laser sensor aligned with a piano like key arrangement etched into a lower surface, a laser pickup, a control unit and a synthesizer. The laser sensors are each individually touch sensitive and require minimal effort to activate. The keys are etched in either a 61 key configuration or 88 key configurations. The laser pickup senses the activation of each laser sensor while the control unit electrically connected to the laser pickup determines which laser sensor(s) are being activated and sends the information to the synthesizer to emit the correct note or chord.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a laser activated synthesizer system that will overcome the shortcomings of the prior art units.

A second object is to provide a laser activated synthesizer system for efficiently translating finger positions on a surface into sounds.

Another object is to provide a laser activated synthesizer system that allows the user to activate the notes of a synthesizer easier and faster.

An additional object is to provide a laser activated synthesizer system that does not require individual keys to be physically depressed.

A further object is to provide a laser activated synthesizer system that would assist individuals that have difficulties in depressing keys on a keyboard (e.g. suffers of arthritis, physically disabled, children).

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
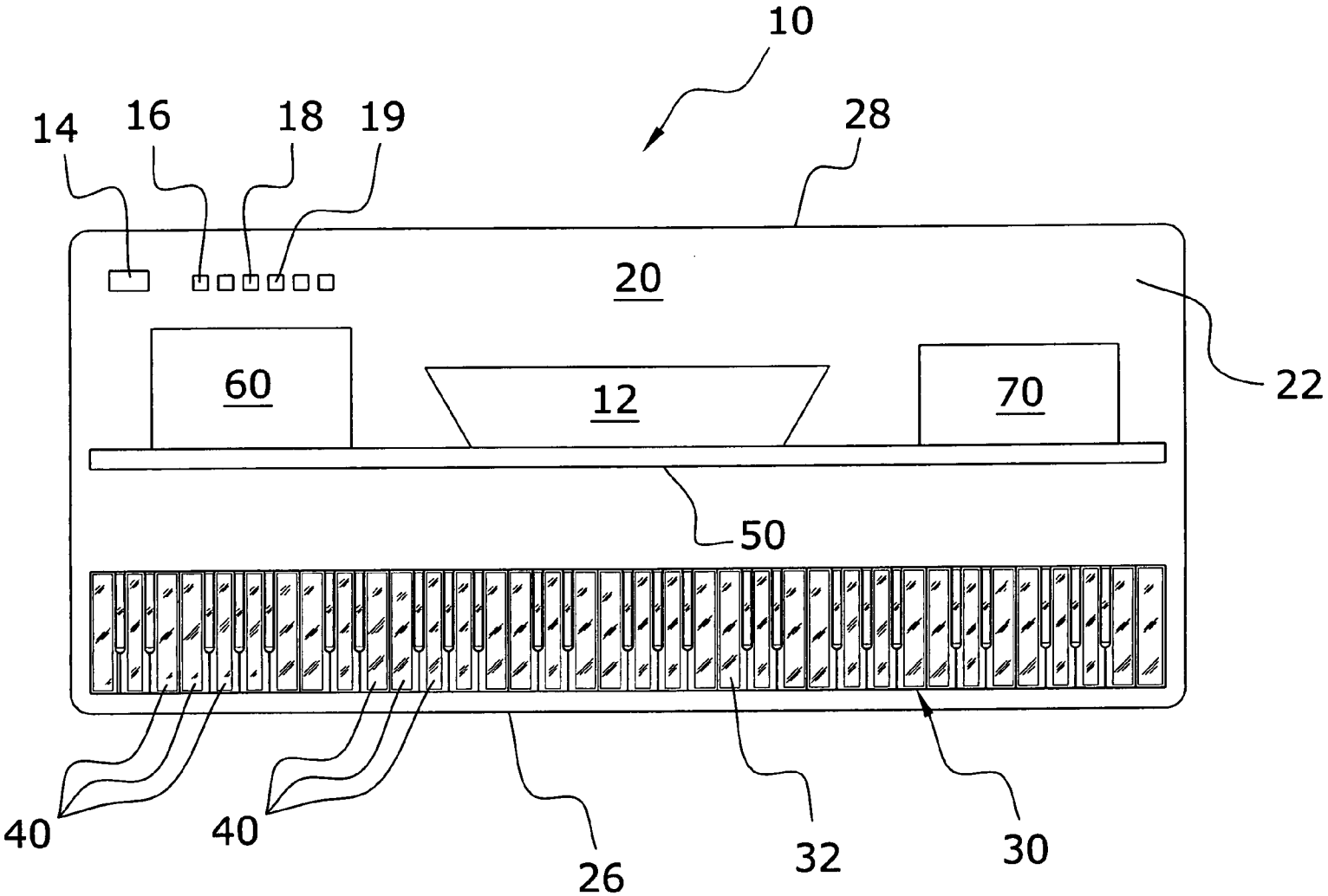
FIG. 1 is a top view of the present invention in a 61 key configuration.
Figure 2:
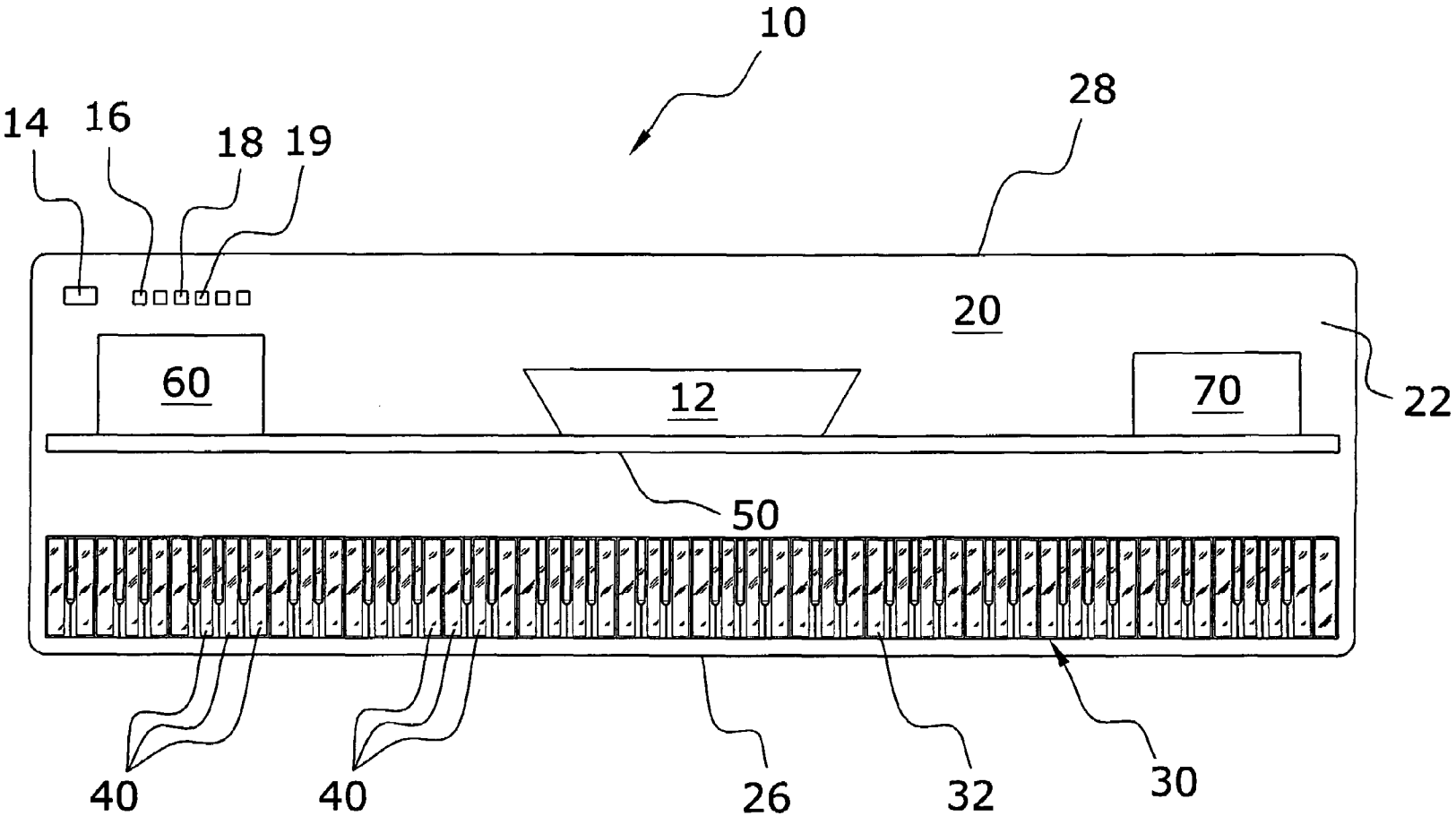
FIG. 2 is a top view of the present invention in an 88 key configuration.

Turning now descriptively to the drawings, in which similar reference characters denote similar elements throughout the several views, FIGS. 1 through 6 illustrate a laser activated synthesizer system 10, which comprises an housing member 20 which encloses a plurality of laser sensors 40 near an upper surface 22, each laser sensor 40 aligned with a piano like key arrangement 30 etched into a lower surface 24, a laser pickup 50, a control unit 70 and a synthesizer 60. The laser sensors 40 are each individually touch sensitive and require minimal effort to activate. The keys are etched in either a 61 key configuration or 88 key configurations. The laser pickup 50 senses the activation of each laser sensor 40 while the control unit 70 electrically connected to the laser pickup 50 determines which laser sensor(s) 40 are being activated and sends the information to the synthesizer 60 to emit the correct note or chord.

B. Housing Member

The housing member 20 is preferably made of a clear material which will withstand exposure to liquids and household cleaning solutions. The housing member 20 is also preferably treated with a hydrophobic coating for easier cleaning. The housing member 20 is preferably comprised of white water tempered glass, but it can be appreciated by one skilled in the art that other materials could also be utilized.

The material of the housing member 20 is also preferably comprised of optically coated and conductive glass commonly used in electrical display units. Optically coated glass provides an anti-reflective surface typically seen in LCD's. Conductive glass provides a material that is electrically conductive while maintaining its optical transparency, both of which are effective in touch screen applications.

As shown in FIGS. 1 through 4, the housing member 20 is preferably a substantially rectangular structure extending at least 1 inch from a lower surface 24 to an upper surface 22. The width of the housing member 20 is dependent on whether the key arrangement 30 is of a 61 key 32 style or an 88 key 32 style. The depth of the housing member 20 from a front side 26 to a back side 28 is preferably between 15 to 24 inches in order to accommodate various internal components that will be discussed in the following sections.

Figure 3:
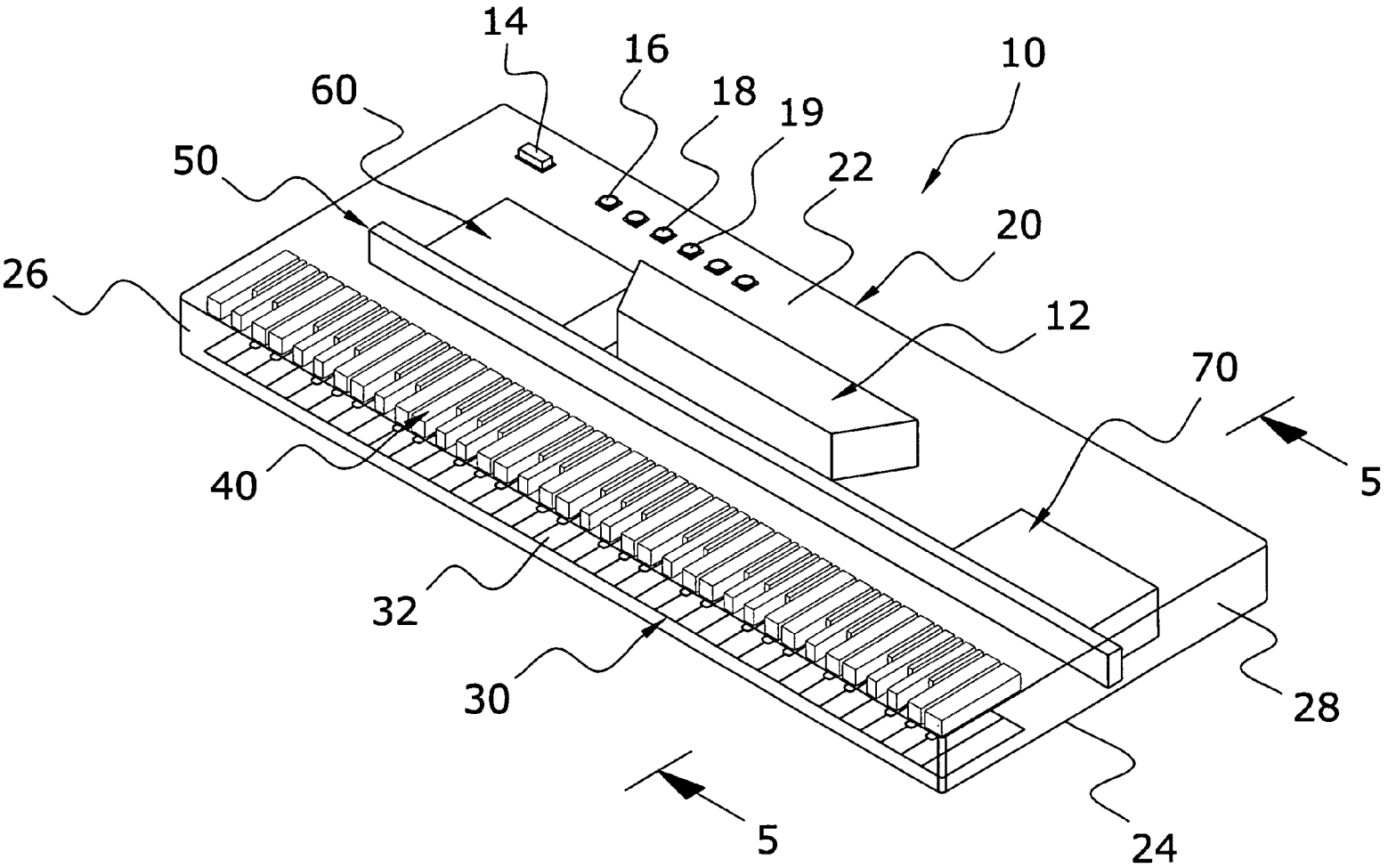
FIG. 3 is an upper perspective view of the present invention in a 61 key configuration.
Figure 4:
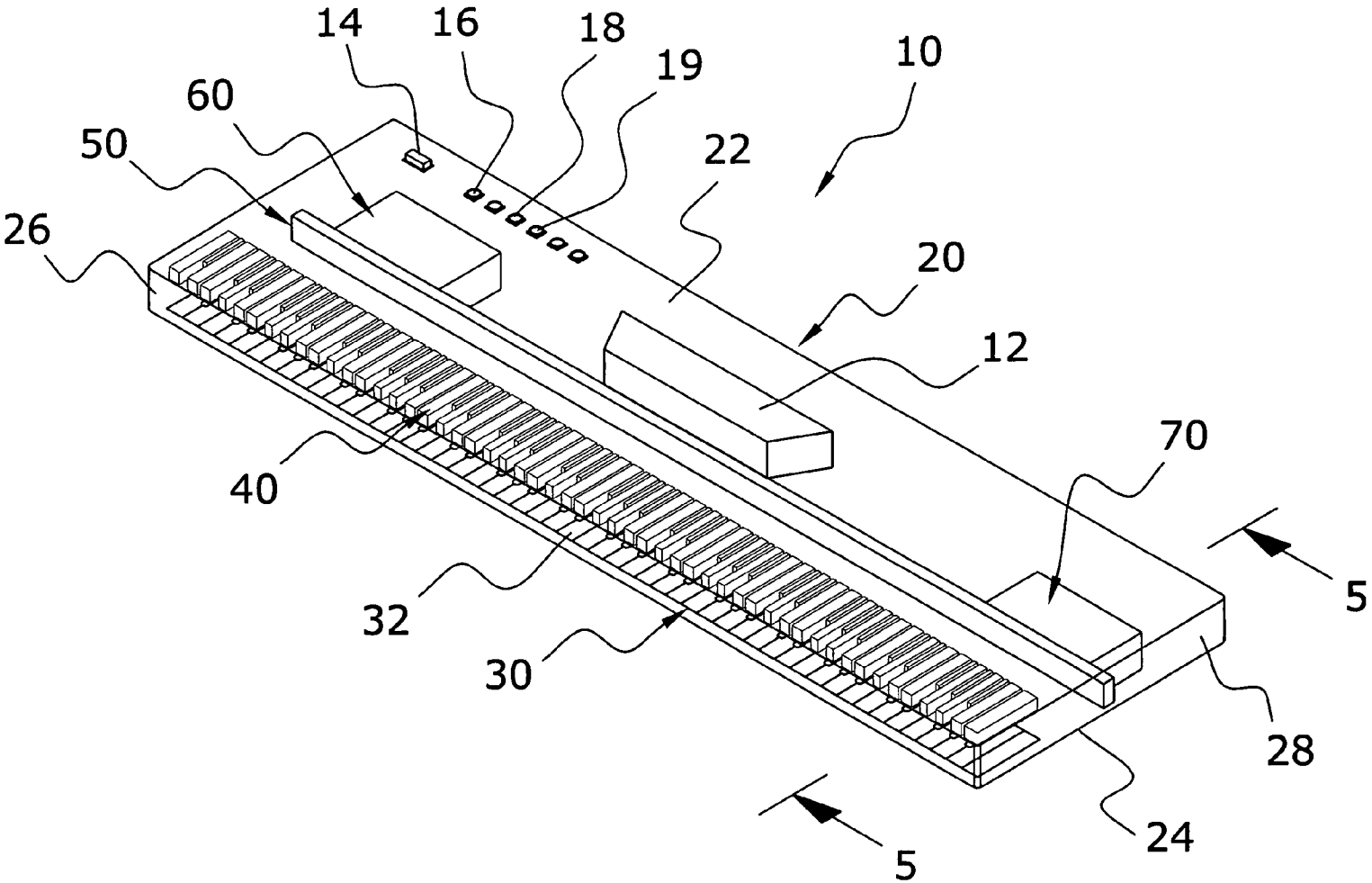
FIG. 4 is an upper perspective view of the present invention in an 88 key configuration.
Figure 5:
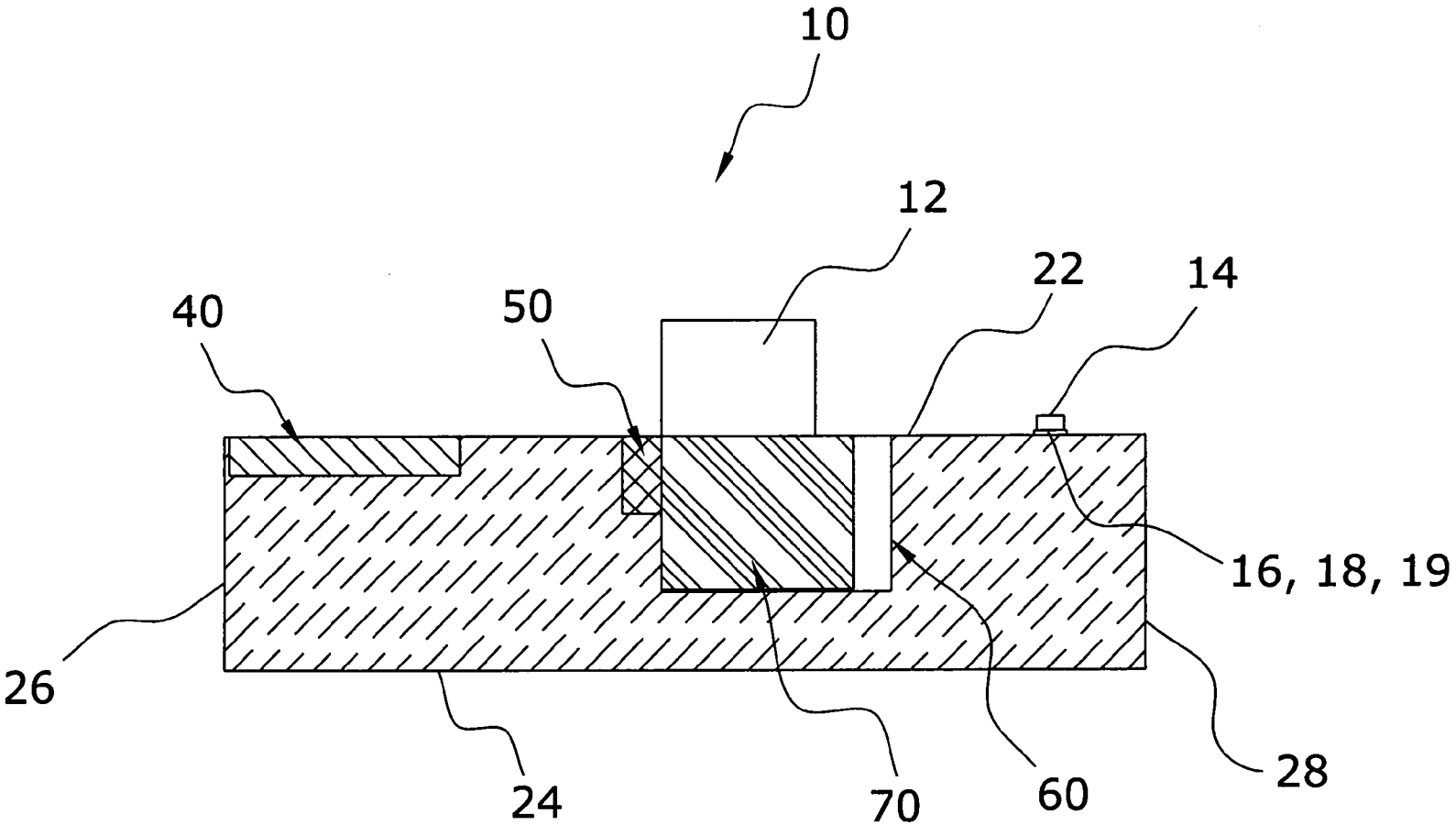
FIG. 5 is a cross sectional view along line 5—5 of FIG. 3.

As shown best in FIGS. 3 and 4, etched on the lower surface 24 and towards a front side 26 of the housing member 20 is a key arrangement 30. The etching traces the outer perimeter of each key 32 on either a 61 key 32 or 88 key 32 piano keyboard configurations.

Located within the housing member 20 is a plurality of cavities. The cavities are used for placing an assortment of components and switches utilized by the laser activated synthesizer system 10. Each cavity preferably has an access opening for initial assembly of the laser activated synthesizer system 10 components and for access during service. It can be appreciated by one skilled in the art that the laser activated synthesizer system 10 components could also be embedded within the housing member 20 during its manufacture.

C. Laser Sensors

The laser sensor 40 utilized by the laser activated synthesizer system 10 is preferably a photonic crystal laser or (quantum cascade) QC laser. The laser sensor 40 belongs to a class of high-performance semi-conductor lasers invented at BELL LABS. U.S. Pat. Nos. 6,711,200 and 6,804,283 both teach exemplary photonic crystal lasers that may be utilized within the present invention and are hereby incorporated by reference. The laser sensor 40 utilizes a layering formation during construction using crystalline semiconductor materials of varying thicknesses. Each laser sensor 40 is pressure activated or touch sensitive requiring minimal pressure for activation. When activated, each laser sensor 40 sends a signal through the housing member 20 material towards a laser pickup for processing.

As shown in FIGS. 1 through 5, the laser sensors 40 are preferably embedded near the upper surface 22 at the front side 26 within the housing member 20. Alternatively, the laser sensors 40 may be directly attached to the upper surface 22 of the housing member 20. Each laser sensor 40 is substantially vertically aligned above the key arrangement 30 located on the lower surface or within a lower portion of the housing member 20. The shape of each laser sensor 40 substantially matches that of each key 32 etched on the lower surface 24, only slightly narrower so no overlapping of the laser sensors 40 occurs.

D. Laser Pickup

The laser pickup 50 is comprised of conventional electronic technology (e.g. mirrors, lenses, photodetectors) capable of accepting the laser signal from each laser sensor 40. As shown in FIGS. 1 through 4, the laser pickup 50 is preferably positioned within the housing member 20 and extends the length of the key arrangement 30 and laser sensor 40 configurations. Configured in this manner, each laser sensor 40 sends a laser signal that is substantially perpendicular to the laser pickup 50, extending from the laser sensor 40 to the laser pickup 50.

In an alternative embodiment (not shown) fiber optic lines embedded within the housing member 20 could extend from each laser sensor 40 in a more condensed configuration. Such a configuration would allow for a laser pickup 50 having a length shorter than that shown in FIGS. 1 through 4. A smaller laser pickup 50 would allow the other components contained within the housing member 20 to be arranged more compact making the laser activated synthesizer system 10 smaller.

Figure 6:
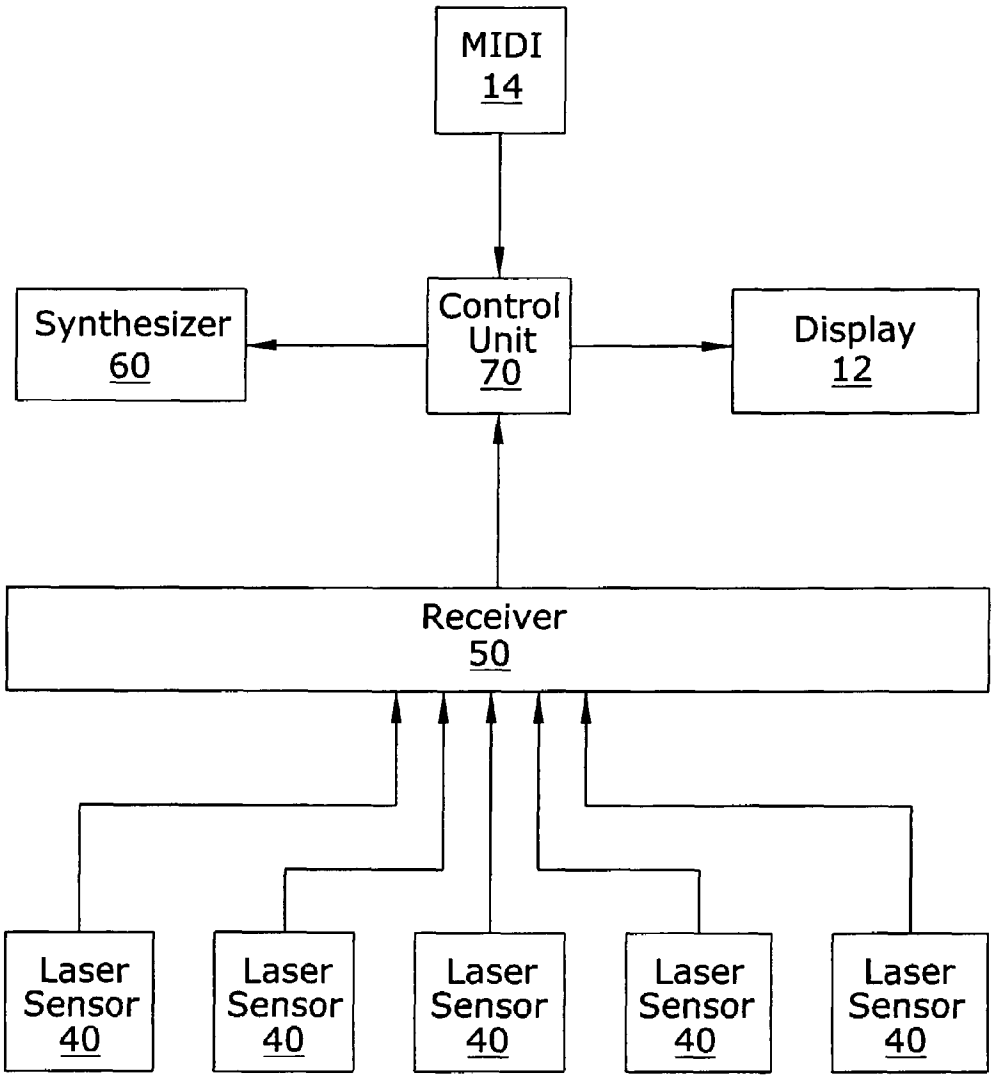
FIG. 6 is a block diagram illustrating the components of the present invention.
Figure 7:
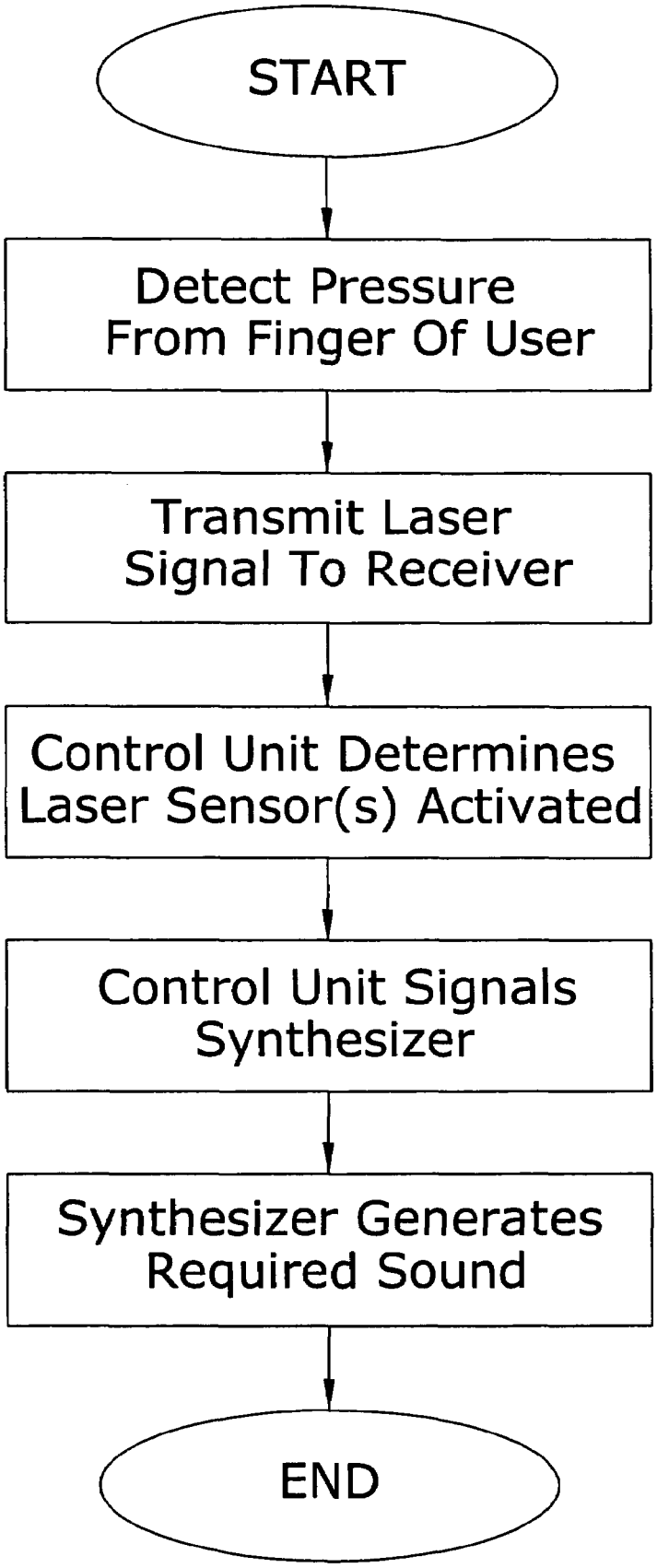
FIG. 7 is a flow chart illustrating the process of the present invention.

The laser pickup 50 receives the laser signals from the laser sensors 40 and the photodetectors convert the laser signals to electrical signals (or related signals) that can be transmitted to the control unit 70 as illustrated in FIG. 6 of the drawings. The laser pickup 50 may be comprised of any conventional technology capable of converting laser signals to electrical signals.

E. Synthesizer and Control Unit

As shown in FIGS. 1 through 4, a synthesizer 60 is positioned within the housing member 20. The synthesizer 60 is comprised of conventional electronic technology capable of being programmed with musical notes, chords and many other sounds. The synthesizer 60 may utilize various electronic technologies such as those commonly utilized in computer sound cards or synthesizers. The synthesizer 60 may be comprised of conventional electronic technology capable of being programmed to facilitate the transfer of data between the laser pickup 50 and synthesizer 60.

As shown in FIGS. 1 through 4, a control unit 70 is preferably positioned within the housing member 20. The control unit 70 is comprised of conventional electronic technology capable of being programmed and facilitating the transfer of data between the laser pickup 50 and synthesizer 60. The control unit 70 may utilize various electronic technologies for example, the control unit 70 preferably includes a central processing unit with a memory buffer and ROM for storing the required operating system and software required to facilitate the transfer of data between the laser pickup 50 and synthesizer 60.

F. Operation of the Invention

In use, the laser activated synthesizer system 10 is used to generate musical sounds and or melodies. By design, the key 32 functionality of the laser activated synthesizer system 10 requires very little pressure to activate and consequently is easy to play for children or those with hand problems (e.g. rheumatoid arthritis).

As shown in FIGS. 1 through 4 and 6 of the drawings, a power source 16 is electrically connected to the laser activated synthesizer system 10 for providing electrical power. The power source 16 is preferably AC electricity normally found in homes or businesses, however the power source 16 may be comprised of other sources (e.g. battery) capable of providing electrical power to the control unit 70 and other electrical units within the present invention. The power within the laser activated synthesizer system 10 is preferably controlled by a power switch 14 to allow the user to turn the present invention on and off. It can be appreciated by one skilled in the art that the location of the power source 16 and power switch 14 could be located in various locations on the housing member 20 to facilitate better functionality.

As shown in FIGS. 1 through 4 and 6 of the drawings other input/output connections are preferably positioned on the upper surface 22 towards the back side 28 of the housing member 20. The input/output connections may consist of a MIDI 18 (Musical Instrument Digital Interface) for communicating with other electrical devices (e.g. computers) or instruments. The input/output connections may also consist of a pedal input 19 used for connecting a pedal accessory or for connecting headphones and the like.

The power is controlled to the electrical components contained within the housing member 20, laser sensors 40, laser pickup 50, synthesizer 60, and control unit 70 by the power switch 14. As shown in FIGS. 1 through 4, with the power switch 14 in the on position, the user may active the laser sensor(s) 40 by lightly pressing on the upper surface 22 of the housing member 20 towards the front side 26. The laser sensors 40 are positioned in a key arrangement 30 that mimics that of a piano keyboard layout allowing the user to utilize the present invention in the same manner.

As each laser sensor 40 is activated, the laser sensor 40 area lights up and a laser signal is sent to and received by the laser pickup 50. The control unit 70, electrically connected to the laser pickup 50 determines which laser sensor 40 has been activated. With the appropriate laser sensor 40 identified, the control unit 70 sends a signal to the synthesizer 60 as to which note or sound is to be generated by the synthesizer 60. The laser activated synthesizer system 10 permits the user to adjust the synthesizer 60 such that each laser sensor 40 can activate a plurality of notes or sounds.

As shown in FIGS. 1 through 4, a display 12 (e.g. LCD) is preferably positioned within the housing member 20. The display 12 can show a plurality of figures or symbols such as the notes being played or the name of melody being played. As shown in FIGS. 1 through 4, the laser activated synthesizer system 10 could be utilized in more portable manner allowing the user to play the present invention at a table, desk top or on their lap. In an alternative embodiment (not shown) the laser activated synthesizer system 10 could be placed on a stationary stand to be utilized in a more traditional piano configuration.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A laser activated synthesizer system, comprising:

a housing member having an upper surface and a lower surface;

a piano key arrangement within said housing member;

a plurality of laser sensors attached to or within said housing member;

a laser pickup within said housing member, wherein said laser pickup is activated by a laser signal from each of said laser sensors; and a synthesizer within said housing member, wherein said synthesizer emits a particular sound dependent on which of said laser sensors activates said laser pickup.

2. The laser activated synthesizer system of claim 1, wherein said housing member is comprised of a transparent or semi-transparent material.

3. The laser activated synthesizer system of claim 1, wherein each of said laser sensors is activated by pressure applied to an upper surface of said housing member.

4. The laser activated synthesizer system of claim 1, wherein each of said laser sensors is positioned above a key in said piano key arrangement.

5. The laser activated synthesizer system of claim 4, wherein each of said laser sensors are embedded within said housing member.

6. The laser activated synthesizer system of claim 1, includes a control unit electrically connected between said laser pickup and said synthesizer, wherein said control unit is enclosed within said housing member, wherein said control unit identifies said laser sensors activating said laser pickup, and wherein said control unit signals said synthesizer as to which of said laser sensors are activated.

7. The laser activated synthesizer system of claim 1, includes a display for showing figures and symbols.

8. The laser activated synthesizer system of claim 1, wherein said piano key arrangement is etched onto said lower surface.

9. A laser activated synthesizer system, comprising:

a housing member having an upper surface and a lower surface;

a piano key arrangement within said housing member;

a plurality of laser sensors attached to or within said housing member near said upper surface;

a laser pickup located within said housing member, wherein said laser pickup is activated by a signal from each of said laser sensors;

a control unit located within said housing member and electrically connected to said laser pickup, wherein said control unit identifies said laser sensors activating said laser pickup; and a synthesizer located within said housing member and electrically connected to said control unit, wherein said synthesizer emits a particular sound dependent on which of said laser sensors is identified by said control unit.

10. The laser activated synthesizer system of claim 9, wherein said housing member is comprised of a transparent or semi-transparent material.

11. The laser activated synthesizer system of claim 9, wherein each of said laser sensors is activated by pressure applied to an upper surface of said housing member.

12. The laser activated synthesizer system of claim 9, wherein each of said laser sensors is positioned above a key in said piano key arrangement.

13. The laser activated synthesizer system of claim 12, wherein said laser sensors are embedded within said housing member.

14. The laser activated synthesizer system of claim 9, includes a display for showing figures and symbols.

15. The laser activated synthesizer system of claim 9, wherein said piano key arrangement is etched onto said lower surface.

16. A laser activated synthesizer system, comprising:

a housing member having an upper surface and a lower surface, wherein said housing member is comprised of a transparent or semi-transparent material;

a piano key arrangement etched into said lower surface;

a plurality of pressure activated laser sensors embedded within said housing member near said upper surface, wherein each of said laser sensors is substantially vertically aligned with a key in said piano key arrangement;

a laser pickup enclosed within said housing member, wherein said laser pickup is activated by a laser signal from each of said laser sensors;

a control unit electrically connected to said laser pickup and enclosed within said housing member, wherein said control unit identifies said laser sensors activating said laser pickup;

a synthesizer electrically connected to said control unit and enclosed within said housing member, wherein said synthesizer emits a particular sound dependent on which of said laser sensors is identified by said control unit; and a display electrically connected to said control unit, wherein said display shows figures and symbols.

* * * * *